US006695464B1

(12) United States Patent
Wu

(10) Patent No.: US 6,695,464 B1
(45) Date of Patent: Feb. 24, 2004

(54) INSERTING CONDUCTIVE CONNECTION DEVICE OF LAMP ROD

(76) Inventor: Wen-Chang Wu, 235 Chung - Ho Box 8-24, Taipei (TW)

( * ) Notice: Subject to any disclaimer, the term of this patent is extended or adjusted under 35 U.S.C. 154(b) by 0 days.

(21) Appl. No.: 10/376,039

(22) Filed: Mar. 3, 2003

(51) Int. Cl.[7] ..... F21S 8/08

(52) U.S. Cl. ..... 362/410; 362/413; 362/418; 362/429; 362/226

(58) Field of Search ..... 362/226, 249, 362/410, 413, 418, 414, 429, 430; 315/56

(56) References Cited

U.S. PATENT DOCUMENTS 3,949,216 A * 4/1976 Howe ..... 362/222
4,709,313 A * 11/1987 Goralnik ..... 362/414
4,748,549 A * 5/1988 Scheer ..... 362/406
5,475,578 A * 12/1995 Sevack et al. ..... 362/405
6,283,619 B1 * 9/2001 Pulaski et al. ..... 362/405
6,422,722 B1 * 7/2002 Voltolina ..... 362/405
6,565,240 B1 * 5/2003 Wu ..... 362/405

* cited by examiner

*Primary Examiner*—Haissa Philogene

(57) ABSTRACT

The inserting conductive connection device of a lamp rod includes a pair of upper lamp rod and a lower lamp rod, an inner walls of the upper lamp rod and lower lamp rod are formed with a first threaded section and a second threaded section, respectively; a connecting seat assembled to a top of the lower lamp rod. The connecting seat includes a large annular surface and a small annular surface; a conductive seat assembled to a bottom of the upper lamp rod. In assembly, an annular cork and a positioning ring are locked to an interior of the upper lamp rod and lower lamp rod, respectively, for positioning the lamp rod. Since the positioning ring is not directly locked to the upper lamp rod; when the positioning ring is locked by hand tool, the insertion of the receptacle and plug will not be affected.

4 Claims, 7 Drawing Sheets

INSERTING CONDUCTIVE CONNECTION DEVICE OF LAMP ROD

FIELD OF THE INVENTION

The present invention relates to lamp rods, and particularly to an inserting conductive connection device of a lamp rod. In that device, an annular cork and a positioning ring are locked into an interior of an upper lamp rod and a lower lamp rod, respectively, for positioning the lamp rod; since the positioning ring is not directly locked to the upper lamp rod; when a positioning ring is locked by a hand tool, the insertion of the receptacle and plug will not be affected.

BACKGROUND OF THE INVENTION

The prior art inserting conductive connection device of a lamp rod has a fixed type. It cannot be assembled to the lamp rod easily by users so that in general the lamp rod is assembled in advance in the manufacturing plants. As a result, the volume is large and is not suitable to be transferred and thus the cost in transformation is high. Moreover, the customers must take a lamp device of a large volume as he (or she) buys the lamp device). This induces some inconvenience to the buyers.

SUMMARY OF THE INVENTION

Accordingly, the primary object of the present invention is to provide an inserting conductive connection device of a lamp rod. The device comprises a pair of upper lamp rod and a lower lamp rod, an inner walls of the upper lamp rod and the lower lamp rod are formed with a first threaded section and a second threaded section, respectively; a connecting seat assembled to a top of the lower lamp rod; wherein the connecting seat includes a large annular surface and a small annular surface; the large annular surface of the connecting seat is a threaded surface for locking the lower lamp rod, and an interior of the small annular surface is locked with a receptacle by a stud; a conductive seat assembled to a bottom of the upper lamp rod; wherein the connecting seat includes a positioning ring having a threaded section at a bottom thereof, a plug buckled at a center of the positioning ring; and a threaded rod for locking the plug and an annular cork; a center of the positioning ring has a hollow central hole; a top of the plug protrudes with an annular flange; thereby, after the plug inserts from a lower end of the positioning ring, the annular flange exactly resists against a lower edge of the central hole of the positioning ring; a top of the plug is installed with a threaded hole; a half of the threaded rod is locked in the threaded hole and another half of the threaded rod is locked to the annular cork so as to lock the positioning ring, the annular cork, and the plug into the upper lamp rod; wherein in assembly, the annular cork and the positioning ring are locked to an interior of the upper lamp rod and lower lamp rod, respectively, for positioning the lamp rod; since the positioning ring is not directly locked to the upper lamp rod; when the positioning ring is locked by hand tool, the insertion of the receptacle and plug will not be affected.

The various objects and advantages of the present invention will be more readily understood from the following detailed description when read in conjunction with the appended drawing.

BRIEF DESCRIPTION OF THE PREFERRED EMBODIMENTS

Figure 1:
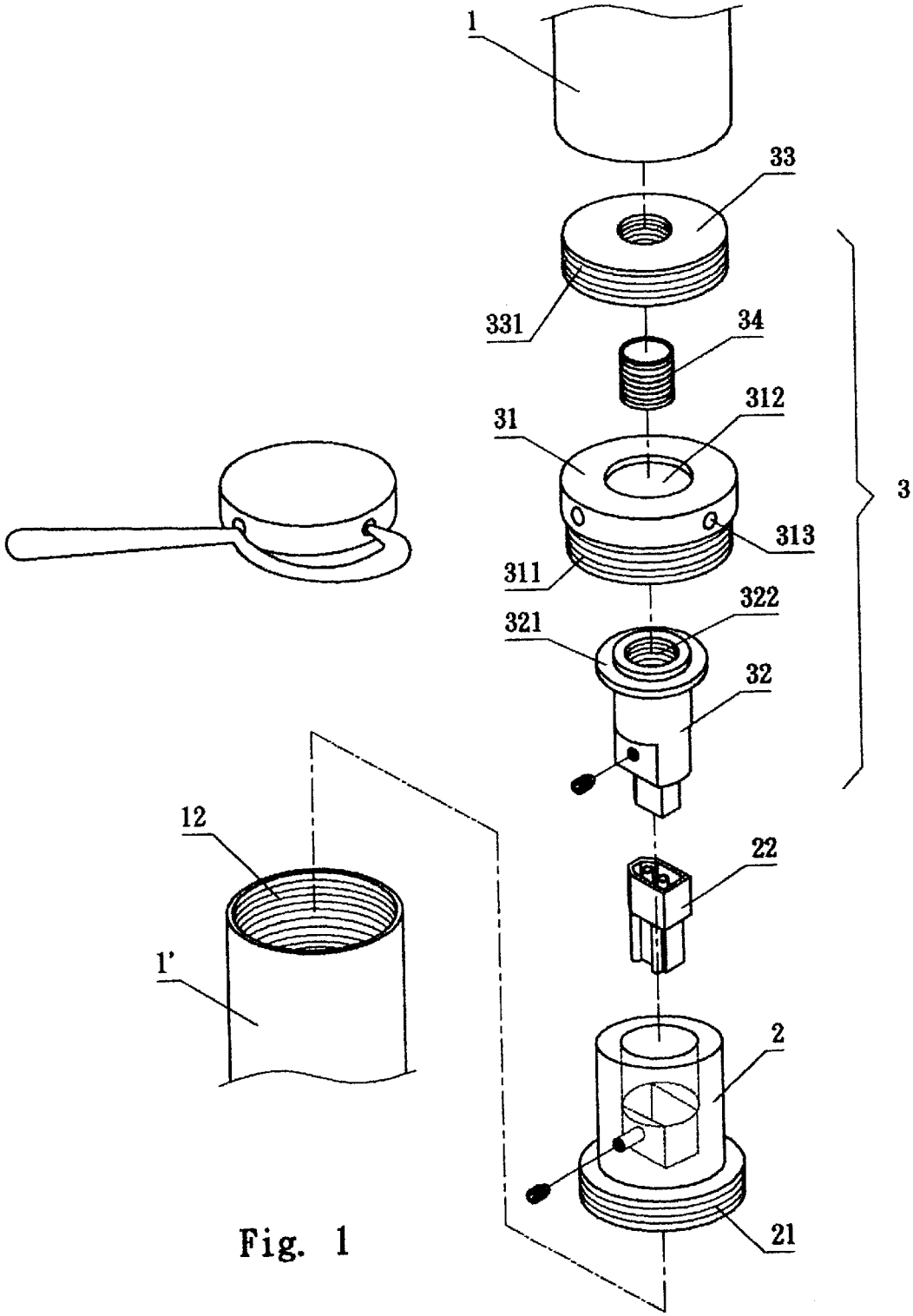
FIG. 1 is an exploded perspective view of the present invention.
Figure 2:
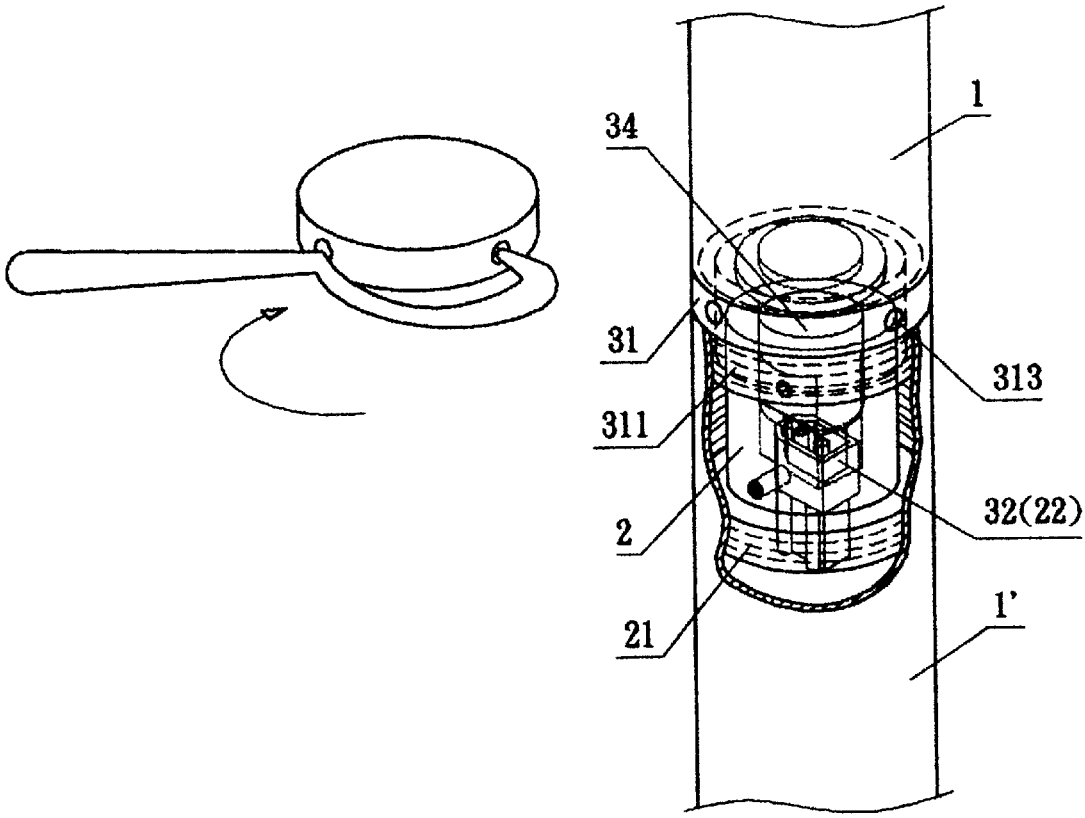
FIG. 2 is a schematic perspective view of the present invention.

Referring to FIGS. 1 and 2, the structure of the present invention is clearly shown. The inserting conductive connection device of a lamp rod includes a pair of upper lamp rod 1 and a lower lamp rod 1', a connecting seat 2 assembled to a top of the lower lamp rod 1', and a conductive seat 3 assembled to a bottom of the upper lamp rod 1.

The inner walls of the upper lamp rod 1 and lower lamp rod 1' are formed with threaded sections 11 and 12, respectively for locking the connecting seat 2 and the conductive seat 3.

The connecting seat 2 is a T shape annular structure including a large annular surface and a small annular surface. The large annular surface of the connecting seat 2 is a threaded surface 21 for locking the lower lamp rod 1', and an interior of the small annular surface is locked with a receptacle 22 by a stud.

The connecting seat 2 includes a positioning ring 31 having a threaded section 311 at a bottom thereof, a plug 32 buckled at a center of the positioning ring 31; and a threaded rod 34 for locking the plug 32 and an annular cork 33. A center of the positioning ring 31 has a hollow central hole 312. A top of the plug 32 protrudes with an annular flange 321. Thereby, after the plug 32 inserts from a lower end of the positioning ring 31, the annular flange 321 exactly resists against a lower edge of the central hole 312 of the positioning ring 31 so as to avoid that the positioning ring 31 slides down. A top of the plug 32 is installed with a threaded hole 322. A half of the threaded rod 34 is locked in the threaded hole 322 and another half of the threaded rod 34 is locked to the annular cork 33 so as to lock the positioning ring 31, annular cork 33, and plug 32 into the upper lamp rod 1.

Figure 3:
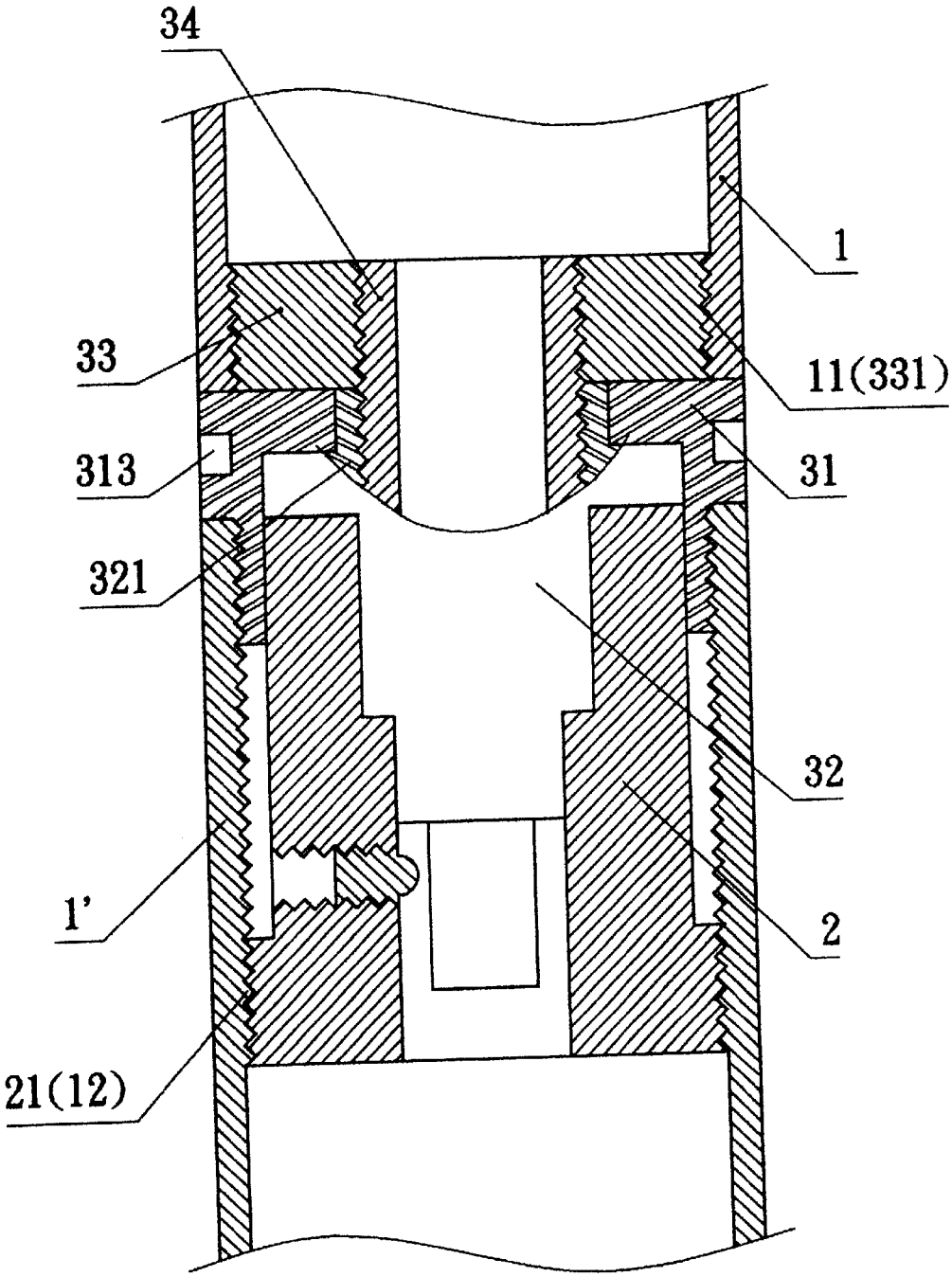
FIG. 3 is an assembled perspective view of the present invention.

The assembly and operation of the present invention will be described herein with reference to FIG. 3. The positioning ring 31 of the conductive seat 3, the annular cork 33, and the plug 32 is locked as an integral body. Then the threaded surface 331 of the annular cork 33 is locked to the threaded section 11 of the upper lamp rod 1 so that the conductive seat 3 and the upper lamp rod 1 are locked as an integral body. The positioning ring 31 is protruded from a lower end of the upper lamp rod 1. Then the connecting seat 2 having the receptacle 22 is locked to the threaded section 12 of the lower lamp rod 1' so that the connecting seat 2 is assembled to the lower lamp rod 1'. Then, the plug 32 of the conductive seat 3 is inserted into the receptacle 22 of the connecting seat 2. Then the positioning ring 31 protruded from a lower end of the upper lamp rod 1 is locked to the lower lamp rod 1'. Since the positioning ring 31 is not directly locked to the upper lamp rod 1, a hand tool can be inserted into an adjusting hole 313 of the positioning ring 31 for rotating the positioning ring 31. The positioning ring 31 will lock to the lower lamp rod 1'0 without affecting the insertion of the plug 32 and the receptacle 22. Thereby, the present invention can be assembled easily.

Figure 4:
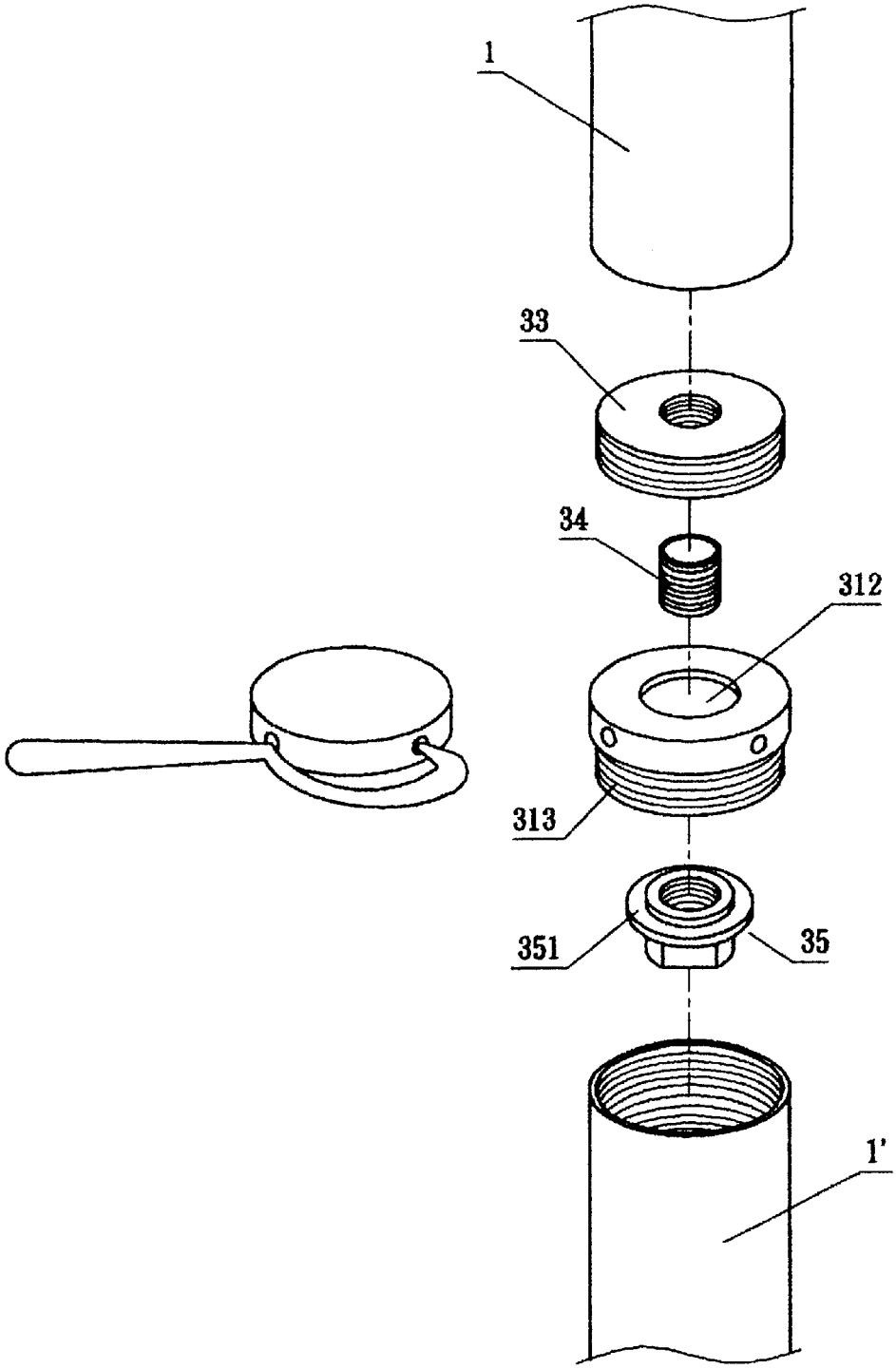
FIG. 4 is an exploded perspective view of another embodiment of the present invention.
Figure 5:
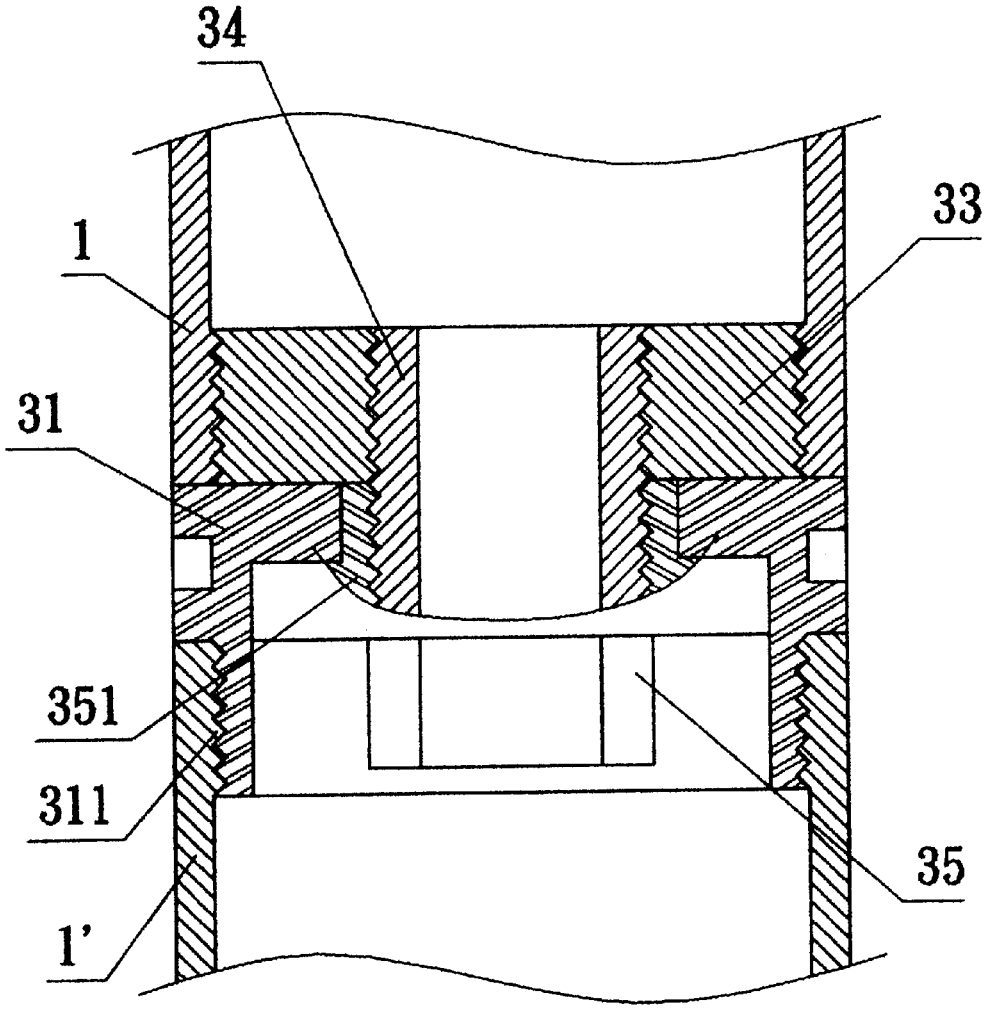
FIG. 5 is a plane cross section view of another embodiment of the present invention.

Referring to FIGS. 4 and 5, another embodiment about the locking of the upper lamp rod and lower lamp rod is illustrated. Above the central hole 312 of the positioning ring 31 is engaged to a nut 35. A center of the nut has a screw hole. A top of the nut is extended with a flange 351. A top of the flange 351 resists against a lower edge of the central hole 312 so as to avoid the positioning ring 31 to slide down. Then the threaded section 311 at the lower end of the positioning ring 31 is directly locked into the lower lamp rod 1' so as to lock the upper lamp rod 1 and lower lamp rod 1' as an integral body.

Figure 6:
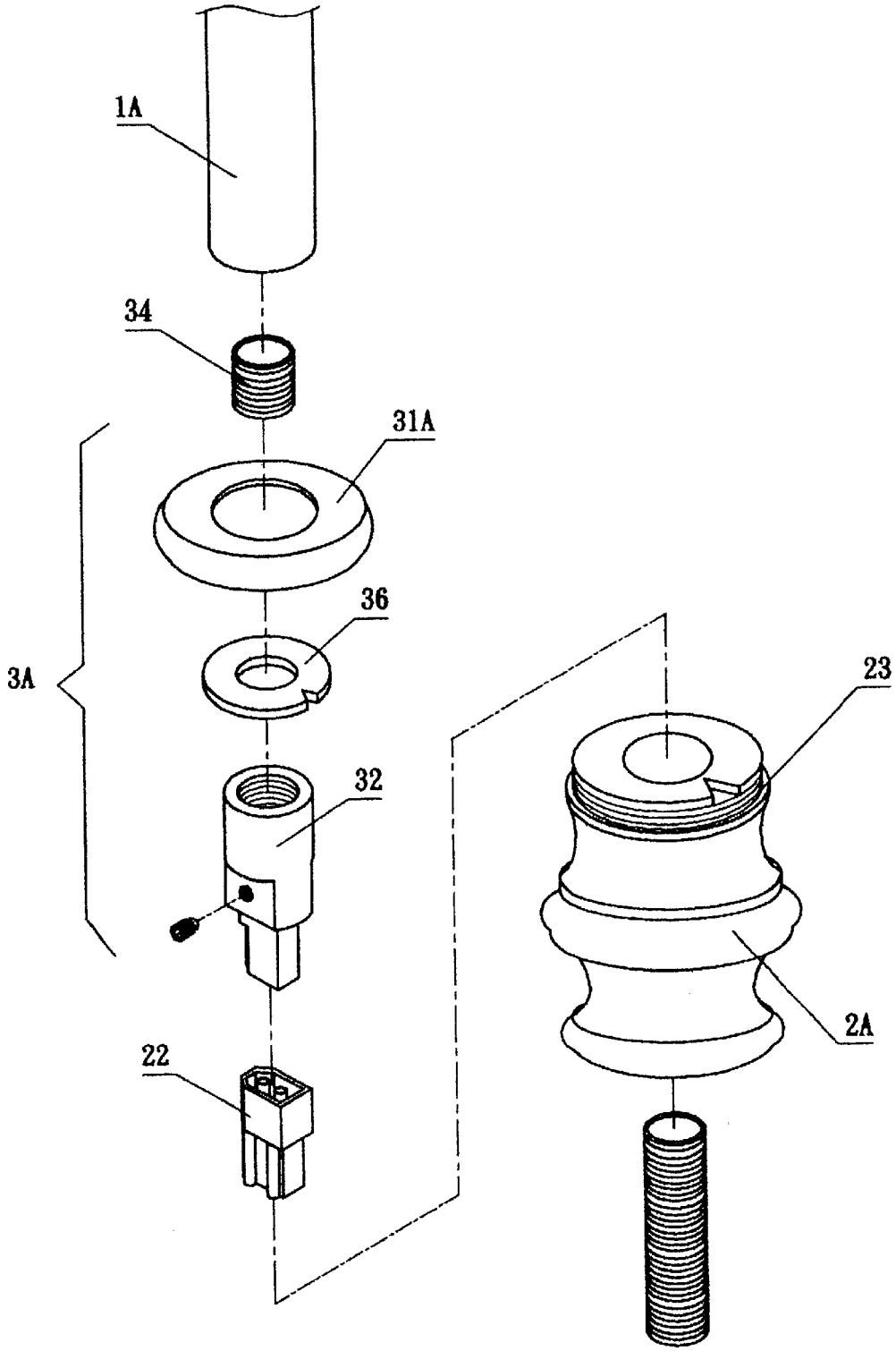
FIG. 6 is an exploded perspective view of a further embodiment of the present invention.
Figure 7:
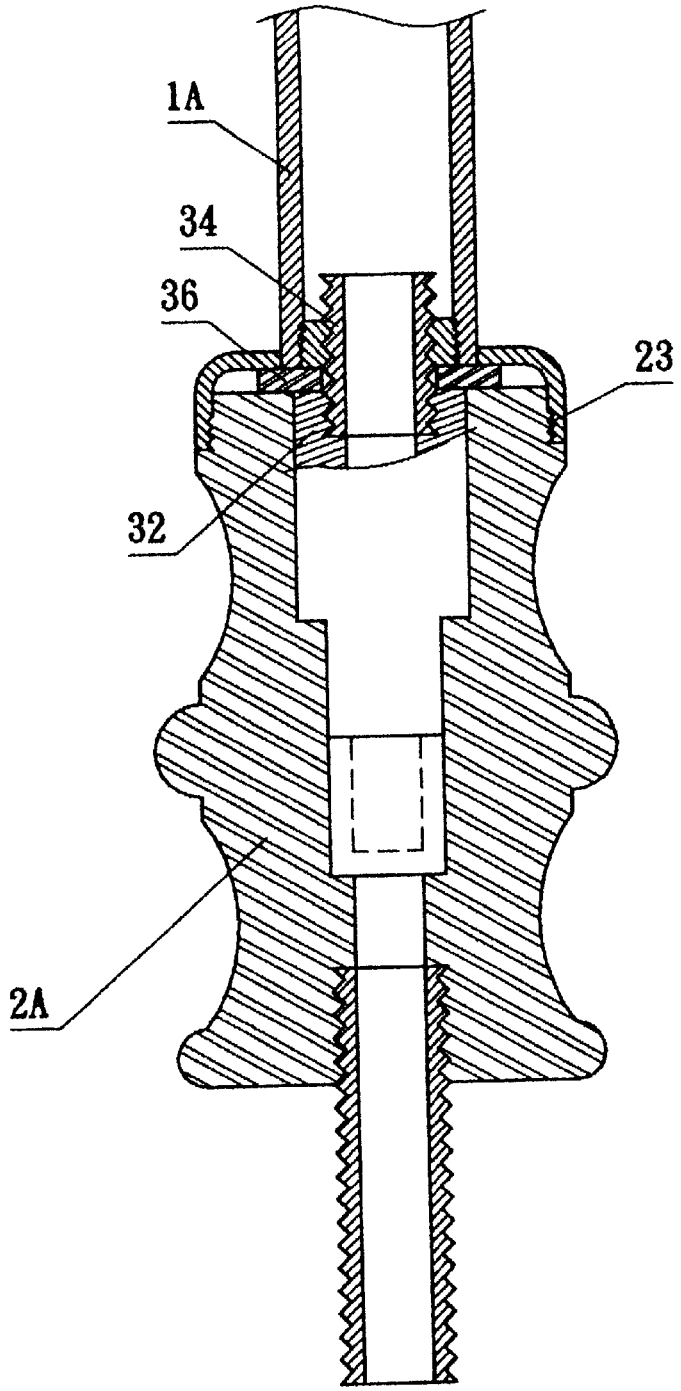
FIG. 7 is a plane cross section view of the further embodiment of the present invention.

Referring to FIGS. 6 and 7, one embodiment that embodiment is used to a table lamp is illustrated. An upper end of a base Al of the table lamp A is connected to a connecting seat 2A. A receptacle 22 is buckled in an interior of the connecting seat 2A. A top of the connecting seat 2A is formed with a threaded section 23. A lamp rod 1A is inserted in the connecting seat 2A of the table lamp A. A lower positioning ring 31 of the lamp rod 1A is installed with a conductive seat 3A. A positioning ring 31A is assembled on the conductive seat 3A. An interior of the positioning ring 31A is buckled with a plug 32 at a center thereof by using a screw rod 34. A washer 36 is placed between the plug 32 and the positioning ring 31A for resisting against the positioning ring 31A so as to avoid the positioning ring 31A to slide down. An upper half of the screw rod 34 is locked to the lamp rod 1A for locking the plug 32, the positioning ring 31A and the lamp rod 1A as an integral body. The positioning ring 31A has a U shape and an interior of the positioning ring 31A has inner threads which are used to lock the threaded section 23 of the connecting seat 2A. Thereby, the lamp rod 1A is assembled to the seat A1.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. An inserting conductive connection device of a lamp rod comprising:

a pair of upper lamp rod and a lower lamp rod, and inner walls of the upper lamp rod and lower lamp rod are formed with a first threaded section and a second threaded section, respectively;

a connecting seat assembled to a top of the lower lamp rod; wherein the connecting seat includes a large annular surface and a small annular surface; the large annular surface of the connecting seat is a threaded surface for locking the lower lamp rod, and an interior of the small annular surface is locked with a receptacle by using a stud;

a conductive seat assembled to a bottom of the upper lamp rod; wherein the connecting seat includes a positioning ring having a threaded section at a bottom thereof, a plug buckled to a center of the positioning ring; and a threaded rod for locking the plug and an annular cork; a center of the positioning ring has a hollow central hole; a top of the plug protrudes with an annular flange; thereby, after the plug inserts from a lower end of the positioning ring, the annular flange exactly resists against a lower edge of the central hole of the positioning ring; a top of the plug is installed with a threaded hole; a half of the threaded rod is locked in the threaded hole and another half of the threaded rod is locked to the annular cork so as to lock the positioning ring, the annular cork, and the plug into the upper lamp rod;

wherein in assembly, the annular cork and the positioning ring are locked to an interior of the upper lamp rod and lower lamp rod, respectively, for positioning the lamp rod; since the positioning ring is not directly locked to the upper lamp rod; when the positioning ring is locked by a hand tool, the insertion of the receptacle and plug will not be affected.

2. The inserting conductive connection device of a lamp rod as claimed as claim 1, wherein an annular surface of the positioning ring is formed with an adjusting hole.

3. The inserting conductive connection device of a lamp rod as claimed in claim 1, wherein a nut is engaged to an upper side of a central hole of the positioning ring; a center of the nut has a screw hole; a top of the nut is extended with a flange; a top of the flange resists against a lower edge of the central hole so as to avoid the positioning ring to slide down; then the threaded section at a lower end of the positioning ring is directly locked into the lower lamp rod so as to lock the upper lamp rod and lower lamp rod as an integral body.

4. An inserting conductive connection device of a lamp rod comprising:

a table lamp;

a base extending from an upper side of the table lamp;

an upper end of a base of the table lamp being connected to a connecting seat; wherein a receptacle is buckled in an interior of the connecting seat; a top of the connecting seat is formed with a threaded section;

a lamp rod is inserted in the connecting seat of the table lamp; a lower positioning ring of the lamp rod is installed with a conductive seat; a positioning ring is assembled on the conductive seat; an interior of the positioning ring is buckled with a plug at a center thereof by using a screw rod; a washer is placed between the plug and the positioning ring for resisting against the positioning ring; an upper half of the screw rod is locked to the lamp rod for locking the plug, the positioning ring and the lamp rod as an integral body;

the positioning ring has a U shape and an interior of the positioning ring has inner threads which -are used to lock the threaded section of the connecting seat; thereby, the lamp rod is assembled to the seat.

* * * * *